US006619088B1

(12) United States Patent
Oyamada et al.

(10) Patent No.: US 6,619,088 B1
(45) Date of Patent: Sep. 16, 2003

(54) BOTTOM DEAD CENTER CORRECTION DEVICE FOR SERVO PRESS MACHINE

(75) Inventors: Yasuhiko Oyamada, Sagamihara (JP); Kunihiro Suzuki, Sagamihara (JP); Youichi Kubota, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 415 days.

(21) Appl. No.: 09/688,576

(22) Filed: Oct. 16, 2000

(51) Int. Cl.[7] ..... B21D 37/00; B21D 7/40; H01R 43/048; B21J 13/02

(52) U.S. Cl. ..... 72/17.2; 72/19.8; 72/21.4; 72/342.7; 72/441; 72/446

(58) Field of Search ..... 72/17.2, 19.8, 72/21.4, 441, 446, 20.2, 342.7

(56) References Cited

U.S. PATENT DOCUMENTS

| | | | | |
|---|---|---|---|---|
| 4,936,126 A | * | 6/1990 | Sato | 72/446 |
| 5,123,165 A | * | 6/1992 | Strong et al. | 29/861 |
| 5,168,736 A | * | 12/1992 | Enneper et al. | 72/21.4 |
| 5,199,290 A | * | 4/1993 | Kashiwagi et al. | 72/441 |
| 5,269,163 A | * | 12/1993 | Yagi et al. | 72/441 |
| 5,271,254 A | * | 12/1993 | Gloe et al. | 72/13.2 |
| 5,337,589 A | * | 8/1994 | Gloe et al. | 72/441 |
| 5,669,257 A | * | 9/1997 | Inoue et al. | 72/441 |
| 5,697,146 A | * | 12/1997 | Inoue et al. | 72/19.8 |
| 5,727,409 A | * | 3/1998 | Inoue et al. | 72/19.8 |
| 5,813,322 A | * | 9/1998 | Kuroda | 72/446 |
| 5,921,125 A | * | 7/1999 | Inoue et al. | 72/441 |

FOREIGN PATENT DOCUMENTS

| | | | |
|---|---|---|---|
| JP | 09-314395 | 12/1997 | B30B/15/06 |
| JP | 10015699 | 1/1998 | B30B/15/06 |
| JP | 10249599 | 9/1998 | B30B/15/28 |

* cited by examiner

*Primary Examiner*—David B. Jones
(74) *Attorney, Agent, or Firm*—Darby & Darby

(57) ABSTRACT

A bottom dead center correction device for a servo press machine which can correct the bottom dead center with a high precision not achieved by a bottom dead center correction by a slide position detection device provided on a frame includes a bottom dead center sensor (11) and a temperature sensor (12) on a lower mold (10B) of a die (10). The bottom dead center of a set slide motion of slide (3) is corrected by the bottom dead center measurement value of bottom dead center detection sensor (11) and by the temperature drift of bottom dead center detection sensor (11) resulting from the temperature rise of die (10) due to molding and detected by temperature sensor (12). A bottom dead center correction of one micron unit not previously achieved becomes possible. The bottom dead center correction device also can be provided as one which corrects for the fluctuations in the bottom dead center resulting from deformations in all of the construction parts and the die of the servo press. It includes a current detection device (8) which detects the current value supplied to a servo motor (5) to a screw shaft (4) which joins with a slide (3). A scale detection device 9 detects the position of slide (3). There is feedback of outputs from a current detection device (8) and a scale detection device (9) to a NC control device (6). When one or the other of either the load value calculated from the current value or the slide position reaches a set value, a correction value is obtained corresponding to the difference between the other value and its set value. The bottom dead center precision can be improved to the range of 1-few microns.

8 Claims, 4 Drawing Sheets

BOTTOM DEAD CENTER CORRECTION DEVICE FOR SERVO PRESS MACHINE

BACKGROUND OF THE INVENTION

The present invention relates to a bottom dead center correction device for a servo press machine, in which a slide is raised and lowered with a servo motor as the power source. The present invention is effective for correcting the bottom dead center in one micron units for each stroke of the slide using a detector sensor provided on a die of the machine for detecting bottom dead center measurement value.

It also provides bottom dead center correction is conducted in response to fluctuations in the molding load due to deformations resulting from heat in the construction arts of the servo press or die or due to unevenness in the hardness of the material to be processed.

A servo press machine drives the servo motor so that the bottom dead center of a stroke of the vertical motion of the slide has, as the bottom dead center command value, a bottom dead center setting value which has been set at a control device. The bottom dead center of the slide stroke is maintained at a constant. A bottom dead center detection value is detected by a position detection device, which detects the position of the slide. In addition, by having feedback of the bottom dead center detection value, there is a correction per stroke. Fluctuations in the bottom dead center resulting from distortions of frame parts due to pressure from molding and deformations due to heat generated during rotation and sliding are corrected.

In the prior art, for example, Japanese Laid-Open Patent Number 6-218594 corrects the distortion amount of the frame.

In the above described technology of the prior art, a test molding is conducted when setting the bottom dead center, and the setting value for the bottom dead center is determined from the precision of the molded product. In later moldings, the fluctuation of the bottom dead center due to distortion of frame parts and deformation due to heat generation of moving parts is detected by a slide position detection device. Because correction is conducted to match the detected value with the setting value, the precision of the bottom dead center can be made to 5–10 microns.

However, the slide position detection device detects the position of the slide, but does not measure the actual bottom dead center of the die. If there is any fluctuation in the actual bottom dead center of the die due to a load and the like during the molding, there is no method for correction. There is no way of having a correction that can achieve a bottom dead center precision greater than that described above.

In a known device, the fluctuations of the bottom dead center due to deformations of the construction members as a result of molding load and as a result of heat are corrected, and the distance between the upper surface of the bed or bolster and the lower surface of the slide is measured directly with a linear scale, and the height fluctuation amount is continuously being corrected.

In another prior device, corrections not only of the fluctuations of the bottom dead center due to deformation of the construction parts of the servo press, but also fluctuations due to deformation of the die are made. For example, the touch point at which the punch of the upper mold contacts the processing material, which is supplied onto the lower mold, is detected. At the time of detection, the distance from the bed or bolster upper surface to the slide lower surface is measured. The fluctuation amount of the distance is continually being corrected. According to this device, there can be corrections in response to changes in the thickness of the processing material.

In the above described prior art, with the former method, in which there is correction for the fluctuations of the bottom dead center due to deformations of the construction parts of the servo press or the die resulting from molding force or heat, the bottom dead center precision is maintained at 5–10 microns.

Furthermore, with the latter method, in which in addition to the former method, there is correction for fluctuations of the bottom dead center due to changes in the thickness of the processing material, the bottom dead center precision can be improved by a few microns.

However, there still remains the problem of correcting fluctuations of the bottom dead center arising from fluctuations in the molding load due to variability in the hardness of the processing material. In general, a coil material is used for the processing material. However, even if the coil material is manufactured under conditions in which the thickness and hardness are adequately maintained, the beginning, middle, and end of the coil may not be consistent. The following improvements are still needed: preventing fluctuations in the molding amount resulting from fluctuations in hardness; improving the bottom dead center precision from the 5–10 microns of the prior art; and improving the product precision.

OBJECT AND SUMMARY OF THE INVENTION

An object of the present invention is to solve the above problems and to provide a bottom dead center correction device for a servo press machine which can conduct corrections based on a bottom dead center actual measurement value detected from a bottom dead center detection sensor provided on the die during molding, and which can correct at a bottom dead center precision of 1 micron units.

In a first embodiment of the invention, a bottom dead center correction device for a servo press machine, being a bottom dead center correction device for a servo press machine which has a servo motor as its drive source and controls the vertical linear motion of a slide based on a set top dead center position and a bottom dead center position of the slide, wherein: the bottom dead center position of the slide is corrected by a bottom dead center measurement value detected from at least one bottom dead center detection sensor provided on a die.

In the bottom dead center correction device, the temperature drift of the bottom dead center detection sensor is corrected based on temperature rise value of the die detected by a temperature sensor provided on the die. Furthermore, in order to verify a detection precision of the bottom dead center detection sensor, a detection value from a position detection device, which detects the position of the slide, and an output value from the bottom dead center detection sensor are compared, and failure of the bottom dead center detection sensor can be determined.

Another object of the invention is to provide a device for bottom dead center correction by the load of the servo press. The bottom dead center correction device can correct the bottom dead center fluctuations due to deformation of the construction parts of the servo press and the die resulting from variability in the hardness of the processing material.

In a second embodiment of the invention, a device for correcting a bottom dead center by detecting a molding load in a servo press is provided. The servo press has a servo motor with numerical control as a drive source and provides a slide with a raising and lowering motion. With this embodiment, there is provided: a scale detection device, which detects the distance between a bed or bolster upper surface and a slide lower surface (henceforth referred to as "slide position") and which outputs an electrical position signal; a current detection device, which detects a current value which is supplied to the servo motor and corresponds to the load value of the slide; and an NC control device, which controls a rise and fall motion of the slide by controlling the current value that is supplied to the servo motor so that it corresponds to a pre-set slide motion.

In addition, when one or the other of either the slide load value, which is calculated from a current value inputted from the current detection device, or a slide position, which is inputted from the scale detection device, reaches a set value, the NC control device corrects the set bottom dead center of the slide according to the difference between the other value and its set value.

In this bottom dead center correction device, when the slide load value, which is calculated by the NC control device, reaches a pre-set value, if the slide position, which is outputted from the scale detection device, is higher than a pre-set position, the processing material is determined to have a high hardness, and the set bottom dead center of the slide is corrected downward by the amount of the correction value, and the slide is lowered. Conversely, if the position is lower than the pre-set position, the processing material is determined to have a low hardness, and the set bottom dead center of the slide is corrected upward by the amount of the correction value, and the slide is lowered.

On the other hand, when a slide position, which is outputted from the scale detection device, reaches a pre-set slide position, if the load value, which is calculated by the NC control device, is larger than a pre-set load value, the processing material is determined to have a high hardness, and the set bottom dead center of the slide is corrected downward by the amount of the correction value, and the slide is lowered. Conversely, if the load value is lower than the pre-set load value, the processing material is determined to have a low hardness, and the set bottom dead center of the slide is corrected upward by the amount of the correction value, and the slide is lowered.

Furthermore, a touch point, which is where an upper mold which is lowered together with the slide contacts a processing material supplied onto a lower mold, is detected by a rise in the current value outputted from the current detection device. When the touch point is detected, the corrected value for the set bottom dead center of the slide obtained from an output of the scale detection device can be corrected. In other words, the set bottom dead center of the slide can be corrected in response to changes in the thickness of the processing material.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
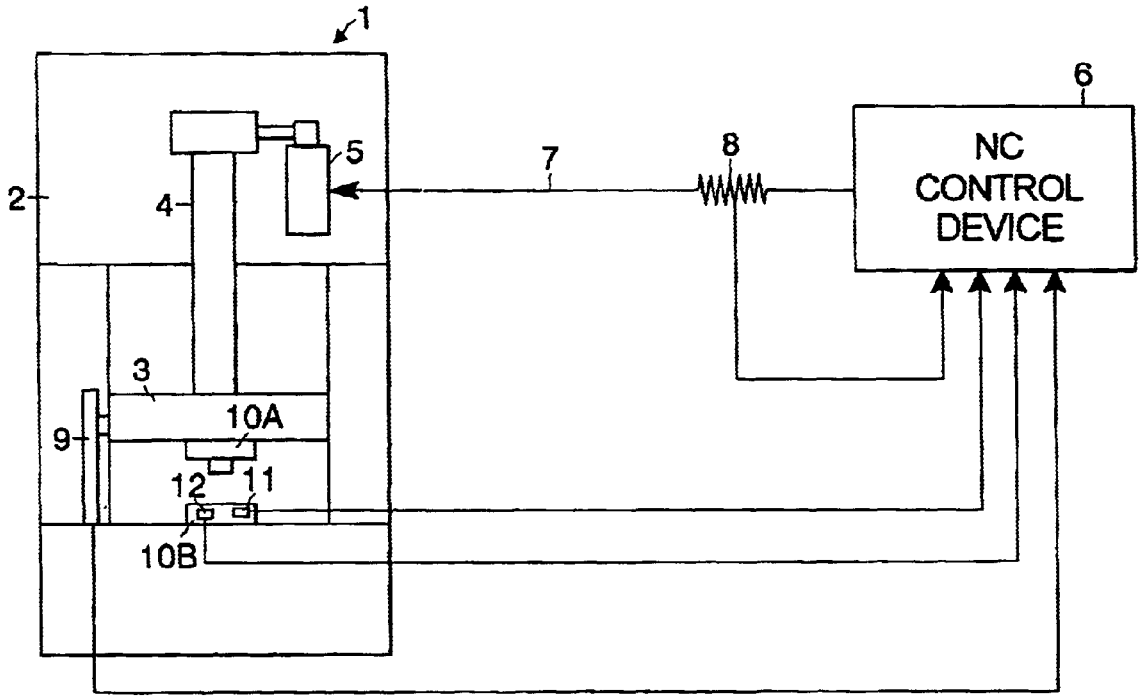
FIG. 1 is a schematic depiction of a first embodiment of bottom dead center correction device of a servo press machine in which the bottom dead center position of the slide is corrected by a bottom dead center measurement detection from a sensor on a die.

Referring to the FIG. 1 embodiment, a servo press machine 1 slide 3 is provided on a frame 2 of servo press machine 1 in a vertically free up and down movement manner. A male screw member 4 is supported in a freely rotating manner on the top part of frame 2 in a vertical reaction. A female screw part 3A of slide 3 and the lower end of male screw member 4 are engaged. Screw member 4 is connected to servo motor 5.

Servo motor 5 conducts the necessary rotation by a controlled current which is supplied from an NC control device 6 via a power current circuit 7. Servo motor 5 makes slide 3 move vertically in a straight line at a constant stroke via male screw member 4.

A current detection device 8 is provided on power current circuit 7. The supplied current value is detected. The detected current value is inputted into NC control device 6 and is used to calculate the pressure of slide 3. Furthermore, in order to detect the position of slide 3 in its vertical movements, a slide position detection device 9, which uses a linear scale, is provided on a part of frame 2 close to or adjacent slide 3. Scale detection device 9 can detect slide position in 1 micron units.

On the lower part of frame 2, in other words on die 10 which is attached between the bed part and slide 3, a bottom dead center detection sensor 11 and a temperature sensor 12 are provided on lower mold 10B.

Bottom dead center detection sensor 11 detects the over current generated when upper mold 10A approaches lower mold 10B, and it measures the distance between upper mold 10A and lower mold 10B. The measurement precision is 0.1 microns.

The bottom dead center of die 10 can be decided at a position at a constant current value of bottom dead center sensor 11. Temperature sensor 12 detects the rise in temperature due to molding of die 10. It is used to correct for the temperature drift generated on the detected value of the bottom dead center detection sensor 11 due to a temperature rise. Although the bottom dead center detection sensor 11 measures the distance between upper mold 10A and lower mold 10B by detecting the over current generated when upper mold 10A approaches lower mold 10B, it has the defect of being an analog system. As described above, corrections for temperature drift and for changes over time become necessary. When using an optical linear scale of a detection value (normally in 0.5–0.1 microns detection units) of slide position detection device 9, the output value of bottom dead center detection sensor 11 when it is approaching the die and the detection value of slide position detection device 9 is compared, and the failure of analog type bottom dead center detection sensor 11 is determined.

With regard to die 10 which may have different deformations in different parts because of molding, a plurality of bottom dead center detection sensors 11 can be built in. An average value from these detection values is then calculated.

Furthermore, bottom dead center detection sensor 11 can be provided on upper mold 10A.

Each of the detection values from slide position detection device 9, bottom dead center detection sensor 11, and temperature sensor 12 are inputted into NC control device 6.

Figure 2:
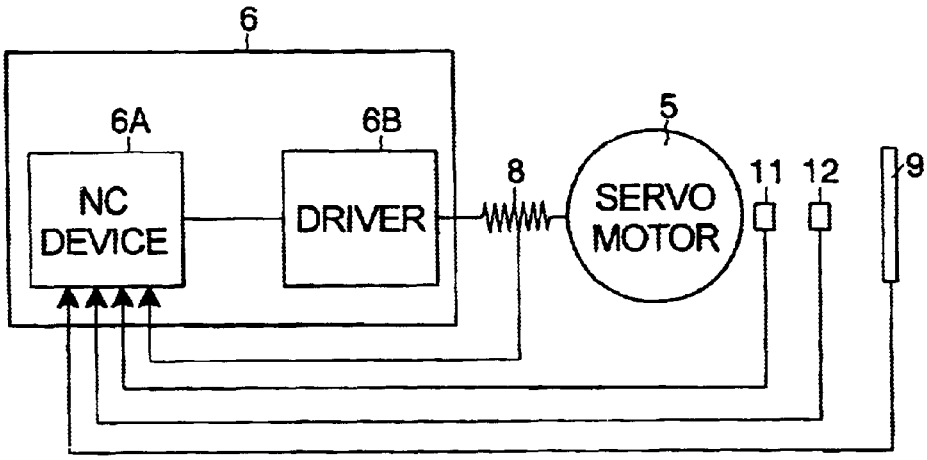
FIG. 2 is a block diagram associated with the detection device of FIG. 1.

Referring to FIG. 2, the control system for the above construction is shown as a block diagram.

NC control device 6 is provided with an NC device 6A and a driver 6B. The detection values from current detection device 8, bottom dead center sensor 11, temperature sensor 12, and slide position detection device 9 are fed back to NC device 6A and converted to numerical values. These are mathematically operated and used in the control.

The necessary data is saved in memory and reproduced and used.

Normally, when slide 3 is moved up and down, a slide motion, in which the top dead center and the bottom dead center are decided on NC device 6A in advance, is set. A set command value is outputted from NC device 6A at a constant time interval. Driver 6B outputs a current value corresponding to the command value, and this is supplied to servo motor 5.

Vertical motion of slide 3 is conducted by the rotation of servo motor 5. The slide motion is controlled by the detection values of the top dead center and bottom dead center detected by slide position detection device 9.

Next, molding is conducted, and when the molded product of the required precision is achieved, the value of the bottom dead center detected by bottom dead center detection sensor 11 is saved in NC device 6A as the bottom dead center correction amount. The determination of the bottom dead center correction amount is conducted by switching on a correction initiation switch (not shown), which is provided on NC device 6A. An average value from a certain number (set in advance) of molding samplings is saved as the bottom dead center correction amount.

Based on the saved bottom dead center correction amount, the bottom dead center position of the slide motion, which has been set in advance, is corrected.

The bottom dead center correction amount can be displayed as a numerical value on a setting device not shown.

A maximum correction amount is determined as the maximum value for correction in order to prevent the breaking of the die. The bottom dead center correction amount is controlled by NC device 6A so that it does not exceed this value.

When molding is continued, a temperature rise is generated in die 10. Based on the temperature measurement value detected by temperature sensor 12, there is correction for the amount of temperature drift of bottom dead center detection sensor 11.

The temperature drift is measured in advance for each bottom dead center detection sensor 11 and is added to the actual bottom dead center correction amount.

Figure 6:
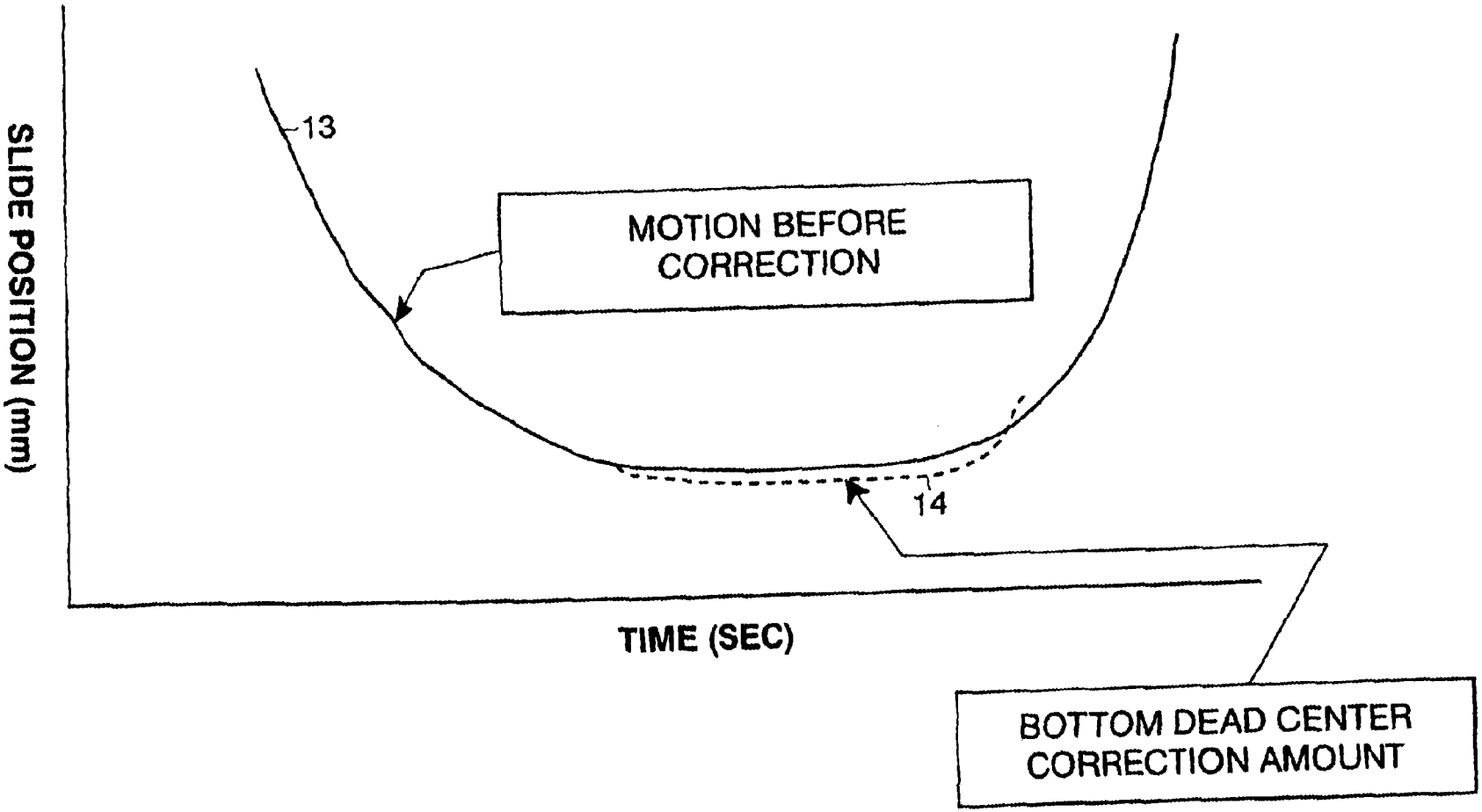
FIG. 6 illustrates curves representing the slide motion before and after correction.

Referring to FIG. 6, the bottom dead center of slide 3, which moves up and down by the command value of the set slide motion, is controlled by feed back of the bottom dead center position of the slide detected by slide position detection device 9. This slide motion of slide 3 is shown as the solid line of the pre-correction slide motion 13. The bottom dead center correction amount obtained by detections from bottom dead center detection sensor 11 and temperature sensor 12 provided on die 10 and lower mold 10B is added to pre-correction slide motion 13. The corrected slide motion is displayed as a dotted line of corrected slide motion 14.

The bottom dead center of pre-correction slide motion 13 is controlled by the detection value from slide position detector 9. As a result, it is corrected for fluctuations of the bottom dead center from the distortions in frame 2 and the fluctuations in the bottom dead center due to heat generation in the servo press machine parts. As described above, the bottom dead center precision is 5–10 micrometers.

The bottom dead center precision of corrected slide motion 14, which is corrected by the bottom dead center correction amount obtained from bottom dead detection sensor 11 provided on die 10, is in 1 micron unit.

Figure 5:
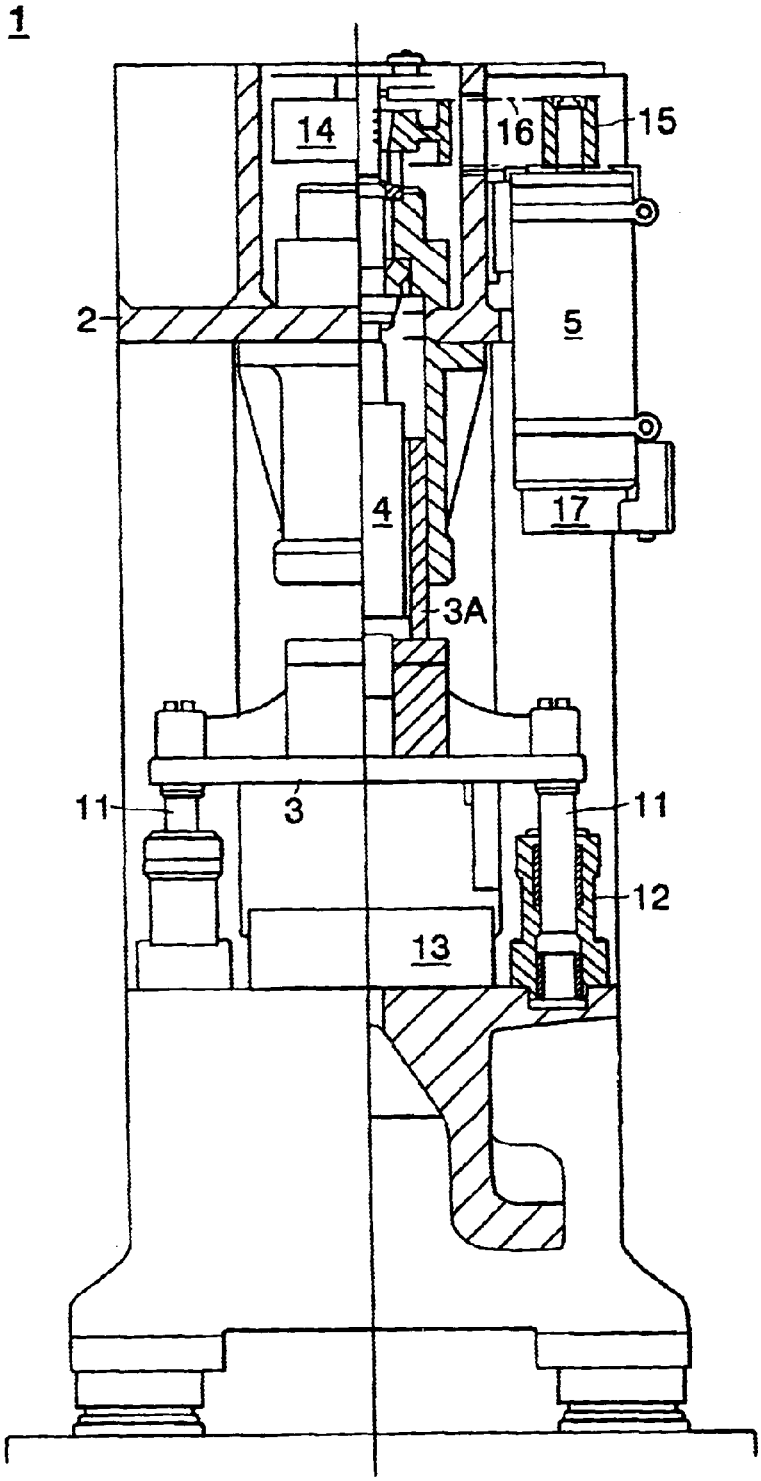
FIG. 5 is a front view partly in section, showing the construction of the servo press machine.

Referring to FIG. 5, the mode of the construction of servo press machine 1 is shown. With slide 3, guide rods 31, which are erected on the lower surface four corners, are guided in the vertical direction by guides 32 of frame 2.

Timing pulley 14, which is fastened to male screw member 4, is connected to timing pulley 15 and timing belt 16, which are provided on the output shaft of servo motor 5 which is fastened to frame 2.

An encoder 17 is connected directly with servo motor 5 and is used in rotation control of servo motor 5. The rotation angle signal from encoder 17 is fed back to NC device 16 and used in rotation control of the servo motor.

On the part of frame 2 adjacent to slide 3, a vertically disposed slide position detection device 9 of a linear scale is mounted.

The opposing die molds 10A and 10B are attached to slide 3 and bolster 21.

As is clear from the above description, according to the present invention, because a bottom dead center detection sensor is provided on the die, a bottom dead center precision of 1 micron unit which could not be achieved in the prior art is achieved. A temperature sensor is provided on the die, and temperature drift of the bottom dead center detection sensor due to the temperature rise from molding can also be detected.

Furthermore, the correction by the bottom dead center detection sensor can be confirmed by conducting measurement of the bottom dead center correction amount anytime during molding. As a result, the bottom dead center precision can be easily maintained.

Figure 3:
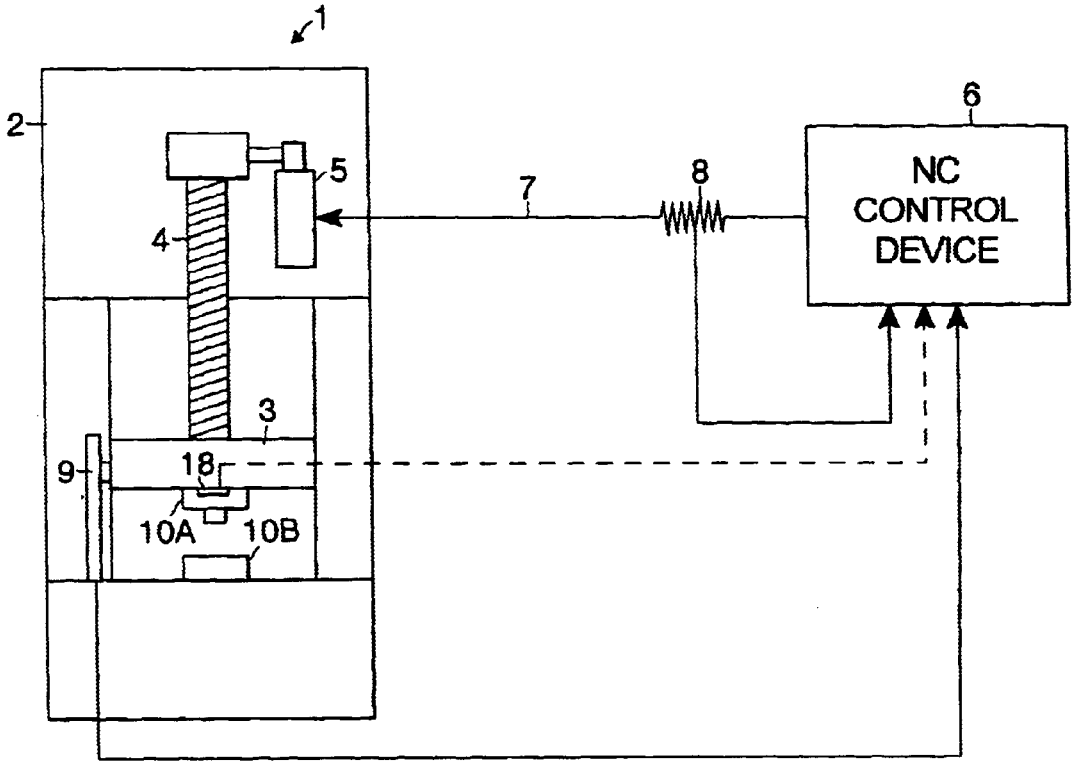
FIG. 3 is a schematic diagram of a second embodiment of correction device employing a detection of a load on the servo press.
Figure 4:
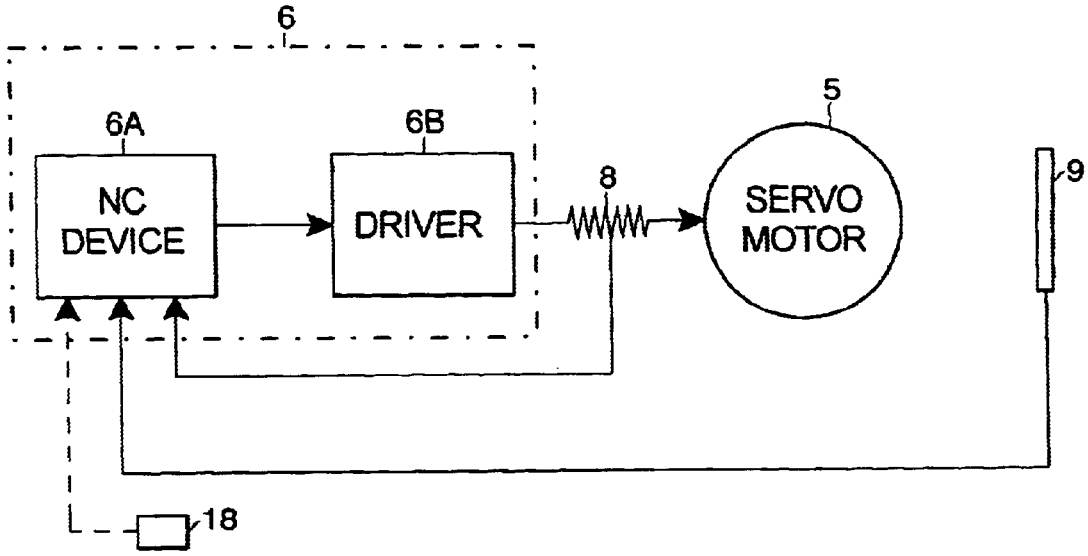
FIG. 4 is a block diagram associated with the detection device of FIG. 3.

Referring to FIGS. 3 and 4, a second embodiment of the present invention of a device for correcting the bottom dead center by detecting the load of a servo press is described.

Referring to FIG. 4, a control system for servo motor 5 which controls the ascending and descending motion of slide 3 is shown. NC control device 6 is constructed from the following: a NC device 6A, which outputs pre-set NC signals; and a driver 6B, which outputs a current corresponding to the NC signals outputted from NC device 6A and drives and controls servo motor 5.

In addition, there is feedback to NC device 6A of signals indicating the current value, which represents the slide load detected by current detection device 8, and the slide position, which is detected by scale detection device 9. By conducting calculations with these values, a correction value is obtained and is outputted as a NC signal. A current corresponding to this NC signal is outputted to driver 6B and is used in the rotation control of servo motor 5.

The molding load of slide 3 can be calculated by the following method: a distortion measure is attached to frame 2; and the distortion measure output resulting from the load during molding is inputted into NC device 6A. The molding load can be detected by other methods as well.

In addition, a die upper mold 10A is attached to the lower surface of slide 3. A die lower mold 10B is attached to the upper surface of a bolster, which has been mounted on top of a bed of frame 2. The touch point is where die upper mold 10A reaches the processing material, which has been supplied on top of die lower mold 10B. At this touch point, a rise in the current value due to the initiation of molding is detected by current detection device 8. This is inputted into NC device 6A and is used in the rotation control of servo motor 5.

Details of the bottom dead center correction with the second embodiment now will be described. In the first bottom dead center correction method by the detection of the load with respect to the changes in the hardness of the processing material, first, slide 3 is lowered, and molding is initiated. When the load value of slide 3, as calculated by NC device 6A, reaches a pre-set load value, the slide position detected by scale detection device 9 and a pre-set slide position are compared.

If the detected slide position is higher than the pre-set position, the hardness of the processing material is determined to be higher than the standard hardness. The difference in the slide position, corresponding to the difference with the standard value of hardness, is detected, and the set bottom dead center of slide 3 is corrected so that it is lower, and molding is conducted by lowering slide 3 to the corrected bottom dead center. Furthermore, correction values are determined by data obtained beforehand by molding processing materials having a standard value of hardness and materials having values different from the standard value. These are saved in NC device 6 and used for the pre-set load value and slide position.

Conversely, when the slide position is lower than the pre-set position, the hardness of the processing material is determined to be lower than the standard hardness. The difference in the slide position, corresponding to the difference with the standard value of hardness, is detected, and the set bottom dead center of slide 3 is corrected so that it is higher, and molding is conducted by lowering slide 3 to the corrected bottom dead center. The correction value of the bottom dead center corresponding to the difference with the standard value of hardness is determined as described previously by data obtained by molding processing materials having a standard value of hardness and materials having values different from the standard value. With this correction, the bottom dead center precision of slide 3 can be in the range of one to a few microns.

In the second method for bottom dead center correction by detection of the load with respect to changes in the hardness of the processing material, first, slide 3 is lowered, and molding is initiated. When the slide position detected by scale detection device 9 reaches a pre-set slide position, the load value, which is calculated by NC device 6A from the current value detected by current detection device 8, and a pre-set load value are compared.

If the calculated load value is higher than the pre-set load value, the hardness of the processing material is determined to be higher than the standard hardness. The difference in the load value, corresponding to the difference with the standard value of hardness, is detected, and the set bottom dead center of slide 3 is corrected so that it is lower. Molding is conducted by lowering slide 3 to the corrected bottom dead center. As described previously, the pre-set load values and slide positions are determined by data obtained beforehand by molding processing materials with a standard value of hardness and materials having values different from the standard value.

Conversely, when the load value is lower than the pre-set load value, the hardness of the processing material is determined to be lower than the standard hardness. The difference in load value, corresponding to the difference with the standard value of hardness, is detected, and the set bottom dead center of slide 3 is corrected so that it is higher. Molding is conducted by lowering slide 3 to the corrected bottom dead center. The hardness of the processing material is often slightly higher at the leading end and the tail end of the coil material. The middle part is approximately uniform, and there may be areas which have a lower hardness.

The standard hardness of the processing material is determined to be the hardness of an approximately uniform portion in the middle of the coil. A hardness is determined to be higher or lower. As described previously, the bottom dead center correction value, which responds to the fluctuation in the load value due to differences in hardness, is determined by data obtained beforehand by molding processing materials with a standard value of hardness and materials of a hardness different from the standard value. With this correction, the bottom dead center precision of slide 3 can be in the range of one to a few microns.

We have stated up to this point that the thickness of the processing material is uniform, but the thickness of the coil material can change some. If the thickness changes, the molding load values at the same bottom dead center position can fluctuate. First, during the lowering of slide 3, the touch point, which is the point where upper mold 10A reaches the processing material supplied on top of lower mold 10B, is detected by current detection device 8 as a rise in the current value due to the initiation of molding.

At this time, if the slide position detected by scale detection device 9 is the standard value, or in other words, if the thickness is the standard value, the set bottom dead center of slide 3 is not corrected, and molding is conducted by lowering slide 3 to the pre-set bottom dead center. On the other hand, if the slide position is higher than the standard value, the thickness is determined to be thick. The set bottom dead center of slide 3 is corrected, and molding is conducted by lowering slide 3 to a corrected set bottom dead center. Conversely, if the slide position is lower than the standard value, the thickness is determined to be thin, and the set bottom dead center of slide 3 is corrected, and molding is conducted by raising slide 3 to the corrected set bottom dead center.

The correction of the set bottom dead center due to changes in thickness of the processing material can be used in combination with one of either the first or second method for bottom dead center correction by detecting a load in response to changes in the hardness of the processing material. Therefore, a combination can be selected and used by a setting device provided on NC control device 6 of servo press 1.

Referring to FIG. 6, a slide motion from the lowering to the raising of slide 3 is shown. The X-axis is the time axis (SEC), and the Y-axis is the slide position axis (MM). The curve shown as the pre-correction slide motion is the curve of the prior art example with a bottom dead center precision of 5–10 microns.

When correcting by detection of a load in response to changes in the hardness of the processing material and correcting for thickness, the curve of the slide motion becomes the curve shown by the dotted line. Therefore, as described above, with these corrections, the bottom dead center precision is improved and is in the range of one to a few microns. The correction amount is displayed on the screen as the "current correction value".

The above describes one embodiment for a method in which the load is detected by the current in the servo motor, but the actual load can also be detected, for example, by a load cell 18 or the like. In other words, based on the above technical idea, modifications of the design in the construction and detailed parts are included in the present invention.

In the bottom dead center correction device of the prior art, the set bottom dead center is corrected by detecting the fluctuation of the slide position, and the bottom dead center precision is 5–10 microns. In contrast, as is clear from the above description, according to the present invention, by correcting the set bottom dead center by the fluctuation in the molding load, fluctuations in the set bottom dead center due to deformation of all of the construction parts, which includes not only the servo press but also the die, can be corrected. There are considerable advantages to improving the bottom dead center precision to a range of 1 to a few microns.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A bottom dead center correction device for a servo press machine, said correction device comprising:

a servo motor as a drive source therefor, the servo motor controlling vertical linear motion of a press slide based on a set top dead center position and a bottom dead center position of said slide, wherein:

said bottom dead center position of said slide is corrected by a bottom dead center measurement value detected from at least one bottom dead center detection sensor provided on a die of said servo press machine; and a temperature sensor provided on said die for detecting a temperature rise value of said die so that a temperature drift of said bottom dead center detection sensor can be corrected.

2. A bottom dead center correction device for a servo press machine as described in claim 1, further comprising:

a position detection device which detects a position of said slide, a detected value from said position detection device being comparable with an output value from said bottom dead center detection sensor for verifying a detection precision of said bottom dead center detection sensor whereby a failure of said bottom dead center detection sensor can be determined.

3. A device for correcting a bottom dead center by detecting a molding load in a servo press, said servo press, which has a servo motor with numerical control as a drive source, providing a raising and lowering motion of a slide, comprising:

(a) a scale detection device, which detects a position of said slide in a vertical direction and which outputs an electrical position signal;

(b) a current detection device, which detects a load current indicative of molding load supplied to said servo motor;

an NC control device, which controls a rise and fall motion of said slide by controlling said load current that is supplied to said servo motor so that it corresponds to a pre-set slide motion;

when a slide load value, which is calculated from said load current inputted from said current detection device, reaches a set slide load value, said NC control device corrects a set bottom dead center of said slide according to a position correction value, which is a difference between the slide position and a set slide position value.

4. A device for correcting a bottom dead center by detecting a molding load in a servo press as described in claim 3, wherein:

when said slide load value, which is calculated by said NC control device, reaches said set slide load value, if said slide position, which is outputted from said scale detection device, is higher than said set slide position value, the material to be processed is determined to have a high hardness, and said set bottom dead center of said slide is corrected downward by an amount of said position correction value, and said slide is lowered;

conversely, if said position is lower than said set slide position value, the processing material is determined to have a low hardness, and said set bottom dead center of said slide is corrected upward by an amount of said position correction value, and said slide is lowered.

5. A device for correcting a bottom dead center by detecting a molding load in a servo press as described in claim 3, wherein:

a touch point, where an upper mold which is lowered together with said slide contacts a processing material supplied onto a lower mold, is detected by a rise in said load current outputted from said current detection device;

when said touch point is detected, a corrected value for a set bottom dead center of said slide obtained from an output of said scale detection device can be corrected.

6. A device for correcting a bottom dead center by detecting a molding load in a servo press, said servo press, which has a servo motor with numerical control as a drive source, providing a raising and lowering motion of a slide, comprising:

(a) a scale detection device, which detects a position of said slide in a vertical direction and which outputs an electrical position signal;

(b) a load detection cell which detects a slide load value;

an NC control device, which controls a rise and fall motion of said slide by controlling said load current that is supplied to said servo motor so that it corresponds to a pre-set slide motion;

when said slide load value, which is detected by said load detection cell, reaches a set slide load value, said NC control device corrects a set bottom dead center of said slide according to a position correction value, which is a difference between the slide position and a set slide position value.

7. A device for correcting a bottom dead center by detecting a molding load in a servo press, said servo press, which has a servo motor with numerical control as a drive source, providing a raising and lowering motion of a slide, comprising:

(a) a scale detection device, which detects a position of said slide in a vertical direction and which outputs an electrical position signal;

(b) a current detection device, which detects a load current indicative of molding load supplied to said servo motor;

an NC control device, which controls a rise and fall motion of said slide by controlling said load current that is supplied to said servo motor so that it corresponds to a pre-set slide motion;

when said slide position, which is inputted from said scale detection device, reaches a set slide position value, said NC control device corrects a set bottom dead center of said slide according to a load correction value, which is a difference between a slide load value, which is calculated by said NC control device, and a set slide load value.

8. A device for correcting a bottom dead center by detecting a molding load in a servo press as described in claim 7, wherein:

when said slide position, which is outputted from said scale detection device, reaches a set slide position value, if said load value, which is calculated by said NC control device, is larger than said set slide load value, the material to be processed is determined to have a high hardness, and a set bottom dead center of said slide is corrected downward by an amount of said load correction value, and said slide is lowered;

conversely, if said load value is lower than said set slide load value, the processing material is determined to have a low hardness, and a set bottom dead center of said slide is corrected upward by an amount of said load correction value, and said slide is lowered.

* * * * *